US005845630A

United States Patent [19]

Yamada

[11] Patent Number: 5,845,630

[45] Date of Patent: Dec. 8, 1998

[54] PROCESS AND APPARATUS FOR FABRICATING A SEMICONDUCTOR WAFER

[75] Inventor: Naoki Yamada, Kanagawa, Japan

[73] Assignee: Komatsu Electronic Metals Co., Ltd., Kanagawa, Japan

[21] Appl. No.: 840,639

[22] Filed: Apr. 25, 1997

[30] Foreign Application Priority Data

Apr. 25, 1996 [JP] Japan ..... 8-142123

[51] Int. Cl.[6] ..... B28D 1/02

[52] U.S. Cl. ..... 125/12; 125/13.01; 451/273; 451/274; 451/290

[58] Field of Search ..... 125/12, 13.01; 29/412, 417, 25.01; 451/67, 273, 274, 41, 44, 398, 290, 54; 156/154, 153, 257, 155, 645; 437/225, 249

[56] References Cited

U.S. PATENT DOCUMENTS 3,475,867 11/1969 Walsh ..... 51/281
3,831,576 8/1974 Mech ..... 125/12
4,331,452 5/1982 Causey et al. ..... 451/67
5,087,307 2/1992 Nomura et al. ..... 156/154
5,564,409 10/1996 Bonzo et al. ..... 125/12

*Primary Examiner*—David A. Scherbel
*Assistant Examiner*—Derris H. Banks
*Attorney, Agent, or Firm*—Sughrue, Mion, Zinn, Macpeak & Seas, PLLC

[57] ABSTRACT

A process for fabricating a semiconductor wafer and an apparatus for chamfering a semiconductor ingot are provided to precisely perform the chamfering together and reduce significantly the cutting and chamfering time. The semiconductor ingot 2 is rotated with respect to the central axis C while the circumferential surface 21 of the rotating ingot 2 is brought in contact with the uneven surface 11 of a grindstone 1. The circumferential surface of the ingot is chamfered in accordance with the uneven surface 11 of the grindstone 1. A wiresaw is used to cut the semiconductor ingot 2 to obtain the sliced wafers 3.

4 Claims, 3 Drawing Sheets

PROCESS AND APPARATUS FOR FABRICATING A SEMICONDUCTOR WAFER

BACKGROUND OF THE INVENTION

1. Field of the Invention

The present invention relates to a process for fabricating a semiconductor wafer by slicing a semiconductor ingot to obtain a sliced wafer and a processing apparatus for chamfering a semiconductor wafer.

2. Description of the Background Art

Conventionally, in order to obtain a semiconductor wafer by slicing a semiconductor ingot to obtain a sliced wafer followed by further processing the sliced wafer, the peripheral portion thereof is first chamfered so as to prevent any flaw or chipping produced in the next step. However, since the chamfering of the sliced wafers is performed one piece by one piece, the time period required for the chamfering process is very long, and thus has the disadvantage of low throughput.

As a means to overcome the disadvantage, Japanese Patent Examined Publication No. 6-4217 and Japanese Patent Unexamined Publication No. 6-77188 disclose methods wherein a plurality of sliced wafers are clamped together as a bunch, and chamfered together while they are rotated with respect to their central axis.

However, in the above-mentioned method of chamfering sliced wafers together, there remains the problem that making a plurality of sliced wafers in a clamped state is time-consuming and thus is not efficient.

Moreover, there is a possibility that some burrs will be generated between two wafers while the sliced wafers are clamped together as a bunch, and thus it is difficult to precisely chamfer all the sliced wafer together.

SUMMARY OF THE INVENTION

In view of the above problems, the object of the invention is to provide a manufacturing process for fabricating a semiconductor wafer, which can precisely chamfer a plurality of sliced wafers together and significantly reduce the processing time for the slicing and chamfering, and a processing apparatus for chamfering a semiconductor ingot.

Accordingly, the manufacturing process of a semiconductor wafer of the invention includes processing the circumferential surface of a semiconductor ingot prior to slicing to obtain a plurality of sliced wafers, to form the planned chamfered shape at every interval for which the sliced wafers are to be cut; followed by slicing the semiconductor ingot.

Moreover, the processing apparatus for chamfering a semiconductor wafer includes a rotating means for rotating a semiconductor ingot with respect to the central axis thereof; and a grinding means having an uneven circumferential surface corresponding to the chamfered shape of each sliced wafer at every interval for which the sliced wafers are to be cut.

In stead of cutting a semiconductor ingot into sliced wafers, followed by chamfering the peripheral portions of the sliced wafers, as in the prior art, before cutting into sliced wafers, the circumferential surface of the semiconductor ingot is processed to form a chamfered shape, and then the semiconductor ingot is cut to obtain sliced wafers according to the chamfered shape. Accordingly, the processing time of the chamfering step is significantly reduced.

Moreover, it is most preferable to use a wire saw, which has been widely used recently, for the cutting of the semiconductor wafers in accordance with the manufacturing process of the invention. That is, by using this kind of wire saw, a plurality of wafers can be cut simultaneously and the thickness of the obtained wafers is almost uniform. And thus this kind of wiresaw is suitable for use in cutting semiconductor ingots, which have been chamfered at an equal interval in advance, into sliced wafers at a consistent interval.

BRIEF DESCRIPTION OF THE DRAWINGS

The present invention can be more fully understood by reference to the following embodiments and accompanying drawings in which.

EMBODIMENT 1

Figure 1A:
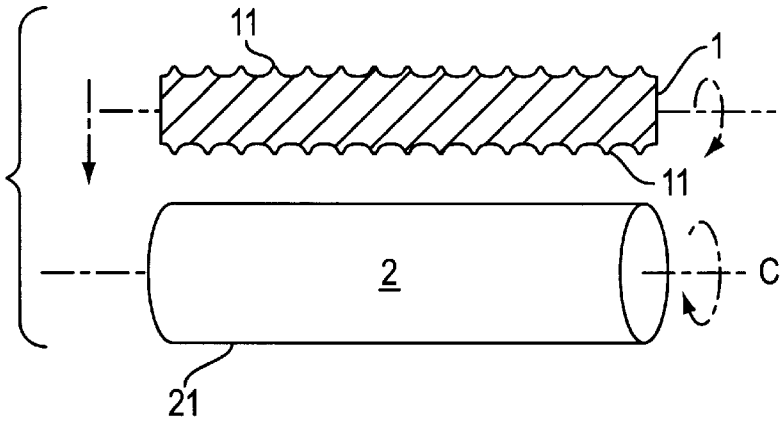
FIGS. 1(*a*)–1(*d*) are schematic diagrams illustrating each steps of the manufacturing process according to Embodiment 1.
Figure 1B:
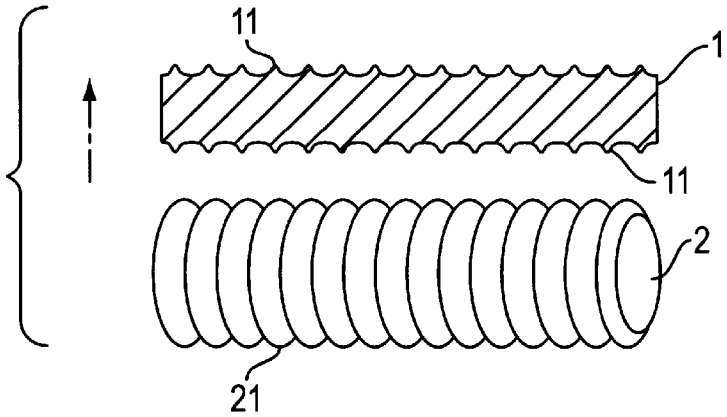
Figure 1C:
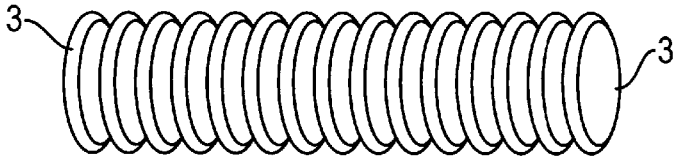
Figure 1D:
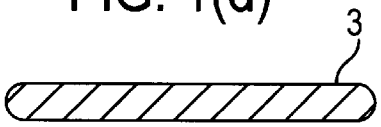
Figure 2A:
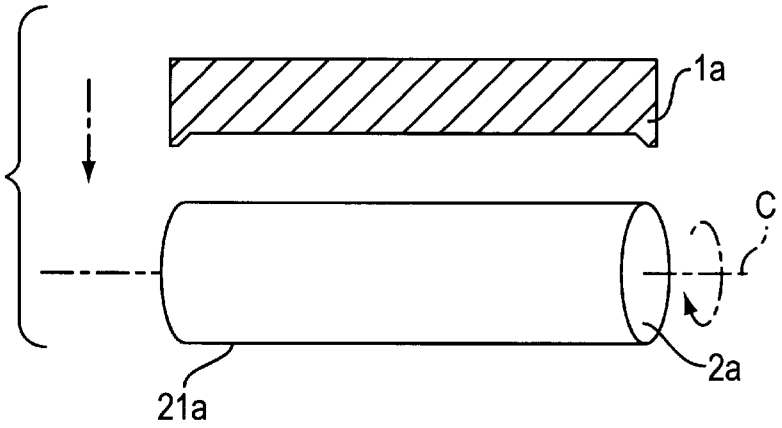
FIGS. 2(*a*)–2(*d*) are schematic diagrams illustrating the process for fabricating a semiconductor wafer according to Embodiment 2.
Figure 2B:
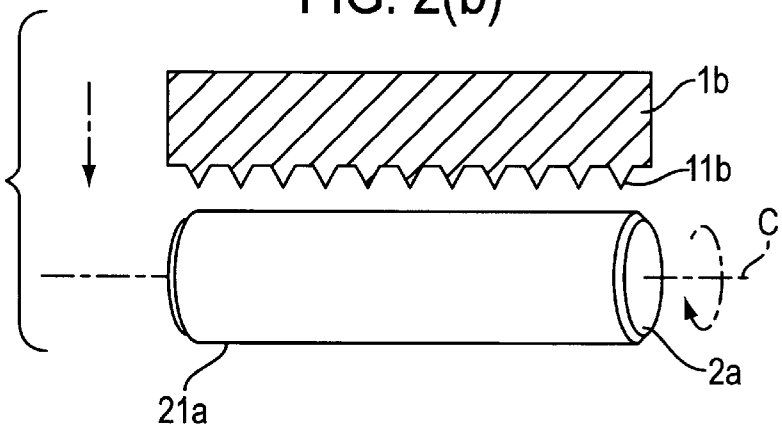
Figure 2C:
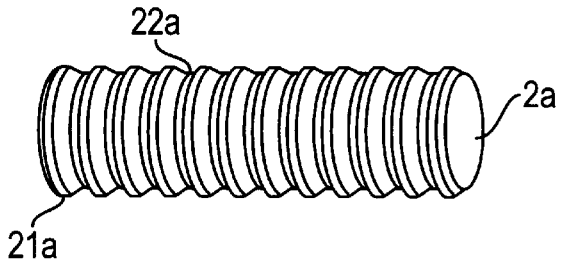
Figure 2D:
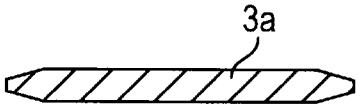

According to the manufacturing process of a semiconductor wafer of the invention, prior to cutting a semiconductor ingot, a chamfering apparatus for performing chamfering on the circumferential surface is used. Accordingly, the chamfering apparatus for the semiconductor ingot is first described.

Referring to FIG. 1(*a*), the chamfering apparatus of Embodiment 1 includes a rotating means (not shown) for rotating a semiconductor ingot 2 with respect to a central axis C, and a grindstone 1 as a grinding means, which is in contact with the circumferential surface 21 of the rotating semiconductor ingot 2 for grinding it into a chamfered shape. The grindstone 1 is cylindrical in shape and is rotatably mounted, and has an uneven circumferential surface 11 corresponding to the chamfered shape at an equal interval.

Moreover, with respect to the rotating means for the semiconductor ingot 2, as long as it can make the semiconductor ingot 2 rotate stably, any rotating means is suitable for use according to the invention. For example, a rotating drum in contact with the circumferential surface or the semiconductor ingot 2 and a means capable of making the central axis C rotate are both suitable for use.

Next, the process for fabricating a semiconductor wafer is described.

Referring to FIG. 1(*a*), the semiconductor ingot 2 is rotated with respect to the central axis C, and the uneven surface 11 of the rotating grindstone 1 is brought in contact with the circumferential surface 21 of the semiconductor ingot 2. By so doing, the circumferential surface 21 of the semiconductor ingot 2 is ground into a shape of the uneven surface 11.

Referring to FIG. 1(*b*), a semiconductor ingot 2 having its circumferential surface 21 ground into the chamfered shape by the uneven surface 11 of the grindstone 1 is obtained.

Referring to FIG. 1(*c*), by cutting with a wiresaw, a plurality of sliced wafers 3 are simultaneously obtained.

Referring to FIG. 1(*d*), it is seen that the sectional view of the sliced wafer 3 has been chamfered so that it can be delivered to the next lapping step or surface grinding step as is.

The time needed for chamfering prior to the cutting, taking a 8-inch wafer for example, is about 3–5 minutes. As about 200 pieces of sliced wafers can be obtained from a semiconductor ingot, the time needed for one sliced wafer is then 3–5/200 minutes. Compared to the approximately 1 minute needed for one sliced wafer according to the conventional one piece-by-one piece chamfering process, it is evident the method of the invention can significantly reduce the chamfering time.

EMBODIMENT 2

In Embodiment 1, the chamfering of a curved shape is performed by using one kind of grindstone. However, in this embodiment, in order to chamfer a tapered shape, a two-stage chamfering is performed.

Referring to FIG. 2(*a*), the semiconductor ingot 2*a* is rotated with respect to the central axis c in the same manner as in Embodiment 1. At first, the entire circumferential surface 21*a* of a semiconductor ingot 2*a* is brought in contact with a grindstone 1*a* having a flat grinding surface to perform the first stage chamfering.

Referring to FIG. 2(*b*), during the first stage of chamfering, the semiconductor ingot 2*a* is processed to have a smooth circumferential surface 21*a*. During the second stage of chamfering, the circumferential surface 21*a* of the semiconductor ingot 2*a* is further ground by a comb-shaped grinding means 1*b* having a plurality of grinding blades 11*b*.

Referring to FIG. 2(*c*), by the second stage of grinding, at the circumferential surface 21*a* of the semiconductor ingot 2, a plurality of grooves 22*a* are formed at an equal interval.

By cutting the chamfered semiconductor ingot 2*a* into sliced wafers as in Embodiment 1, it is possible to obtain a sliced wafer 3*a* having a tapered chamfering surface, as shown in FIG. 2(*d*).

EMBODIMENT 3

Figure 3:
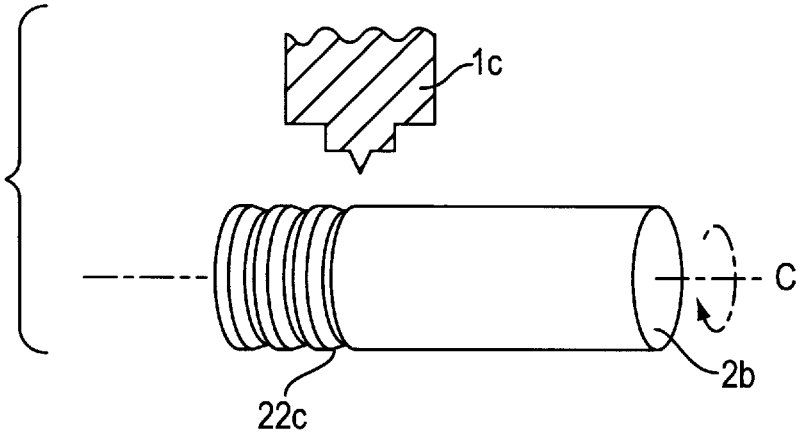
FIG. 3 is a schematic diagram illustrating the chamfering process of a semiconductor ingot according to the manufacturing process of Embodiment 3.

In Embodiment 1 and Embodiment 2, the entire circumferential surface of a semiconductor ingot is chamfered at the same time. However, referring to FIG. 3, in this Embodiment, the semiconductor ingot 2*b* is rotated while a plurality of grooves 22*c* are ground out one at a time by a single-blade grinding means 1*c*. By using this method, the chamfering can still be performed as in the previous embodiments, and the processing time can be reduced compared to the conventional one-piece-at-a-time process.

Optionally, chamfering process can be divided into several stages by using a grinding means capable of forming several grooves in one grinding process.

Moreover, although in the above embodiments a wiresaw is used to perform the cutting, the cutting is not limited to the use of a wiresaw. As long as by controlling the cutting surface, it is possible to cut the semiconductor ingot into sliced wafers in accordance with the thickness corresponding to the chamfering, a cutting using an inner-edged blade can obtain the same effect.

In addition, in the manufacturing of semiconductor wafers having an orientation flat, by providing an orientation flat on the circumferential surface in advance, imitating the circumferential surface of the semiconductor ingot, and cutting after performing the same chamfering as in the previous embodiments, sliced wafers with an orientation flat can be obtained.

Moreover, in the chamfering process, either a grinding process as shown in the above embodiments in which the grindstone is rotated while grinding is performed, or a grinding process in which the grindstone is fixed while grinding is performed can be used. According to the finishing requirement of the chamfered surface of the semiconductor ingot, any grinding process can be used.

The present invention has the above structure, and therefore can chamfer the circumferential surface of a semiconductor ingot together prior to cutting, and has the effect of reducing the chamfering time significantly comparing with the conventional one-piece-at-a-time chamfering process.

In addition, the chamfering can be performed with the ingot being held and precise holding and contact of the ingot is ensured, and thus has the effect of performing chamfering process uniformly.

What is claimed is:

1. A process for fabricating a semiconductor wafer, comprising the steps of:

processing a circumferential surface of a semiconductor ingot prior to cutting to obtain a plurality of sliced wafers, to form a planned chamfered shape at every interval for which the sliced wafers are to be cut; and cutting the semiconductor ingot into the sliced wafers.

2. The process for fabricating a semiconductor wafer, wherein the cutting is performed by using a wiresaw.

3. A processing apparatus for chamfering a semiconductor wafer, comprising a rotating means for rotating a semiconductor ingot with respect to a central axis thereof; and a grinding means having an uneven circumferential surface corresponding to a chamfered shape of each sliced wafer at every interval for which the sliced wafers are to be cut.

4. The processing apparatus for chamfering a semiconductor wafer as claimed in claim 3, wherein the grinding means is a grindstone.

* * * * *